United States Patent [19]

Dey

[11] 4,088,883

[45] May 9, 1978

[54] LUMINAIRE

[75] Inventor: Thomas W. Dey, Rochester, N.Y.

[73] Assignee: Bausch & Lomb Incorporated, Rochester, N.Y.

[21] Appl. No.: 801,279

[22] Filed: May 27, 1977

Related U.S. Application Data

[62] Division of Ser. No. 597,846, Jul. 21, 1975.

[51] Int. Cl.[2] ..... F21V 13/00

[52] U.S. Cl. ..... 362/263; 362/308; 362/328; 362/343

[58] Field of Search ..... 240/41.3, 41.35 C, 41.37, 240/41.4 R, 78 LD, 92, 93, 103 R, 103 B, 106 R, 106.1

[56] References Cited

U.S. PATENT DOCUMENTS

| | | | |
|---|---|---|---|
| 2,143,673 | 1/1939 | Baumgartner | 240/78 LD |
| 2,297,124 | 9/1942 | Anderson | 240/78 LD |
| 2,830,175 | 4/1958 | Janhsen | 240/46.41 |
| 3,283,142 | 11/1966 | Freeman | 240/46.41 |
| 3,835,342 | 9/1974 | Freeman | 240/41.35 C |
| 4,038,542 | 7/1977 | Dey | 240/41.35 C |

OTHER PUBLICATIONS

Schruben, Journal of the Optical Society of America, vol. 64, No. 1, pp. 55–58.

Walsh, "Photometry", Dover Publications, Inc. N.Y., 1st Ed. 1965, pp. 458–459.

*Primary Examiner*—Samuel W. Engle
*Assistant Examiner*—Donald P. Walsh
*Attorney, Agent, or Firm*—Frank C. Parker; Bernard D. Bogdon

[57] ABSTRACT

A luminaire having an aperture provides first and second zonal illumination areas. A reflector is disposed about a light source for reflecting a first portion of light emitted from the light source through a first zone of the aperture. A deviator is disposed within the reflector for permitting passage of the first portion of light and for directing a second portion of light emitted from the light source through a second zone of the aperture.

2 Claims, 5 Drawing Figures

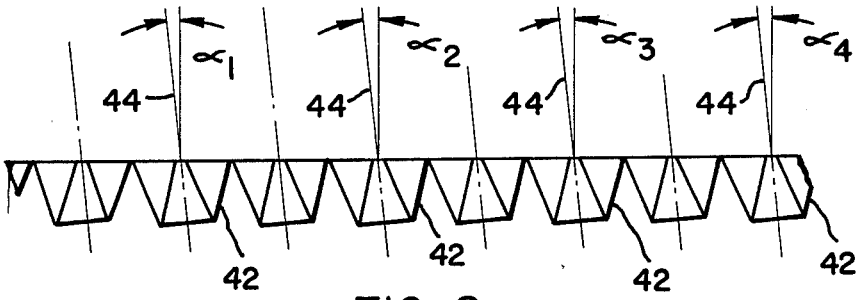
FIG. 2
FIG. 4
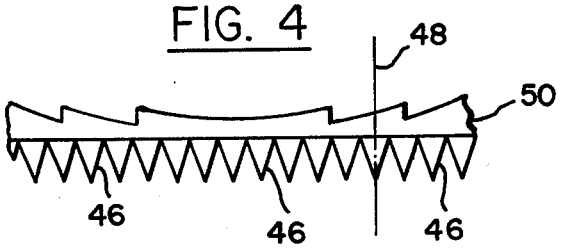
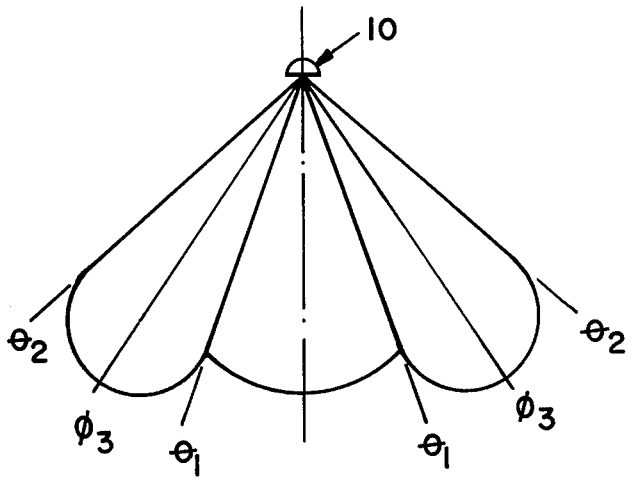
FIG. 5

LUMINAIRE

This is a division of application Ser. No. 597,846, filed July 21, 1975.

BACKGROUND AND SUMMARY OF THE INVENTION

Rapid advances are being made in the lighting industry for improving the lighting efficiency of luminaires. At least two suggested improvements are useable with substantially collimated light. One of these improvements involves a luminaire which radially polarizes the substantially collimated light. The radially polarized light is used to diminish the veiling reflections from a task surface. Another of these improvements involves a lighting panel for controlling the distribution of light passing through the panel. The light passing through the panel is controlled by using a plurality of light modifying elements for critically reflecting and then refracting such light.

It is common practice within the industry to provide substantially collimated light by disposing a lamp within a parabolic reflector. The reflector is sufficiently large so as to make the lamp appear as a "point source". The light rays that are reflected from the reflector are substantially collimated. However, the direct light rays from the lamp through the luminaire's aperture are not substantially collimated. Some solutions that have been attempted to compensate for these direct rays are the use of caps to mask out these rays and reflectors within the luminaire to return these rays past the light source to the parabolic reflector. These solutions, however, adversely effect the lighting efficiency of such luminaires.

The improved luminaire having an aperture of this invention uses substantially all the light emitted from a light source. A reflector is disposed about a light source and reflects a first portion of light emitted from the light source through a first zone of the aperture to provide a first zonal illumination area. A deviator means is disposed within the reflector for directing a second portion of light, different than the first portion of light, emitted from the light source through a second zonal illumination area. Thus, locally unidirectional light is provided across the luminaire aperture since the deviator prevents the direct passage of light rays from the light source through illumination points in the first illumination zone which receive reflected light from the surface of a reflector which is shaped and constructed according to the principles of the present invention.

Further, the improved luminaire may include a light modifying means disposed at least across the first zone of the aperture for controlling light passing through the first zone. This light modifying means is designed to control the distribution of light within a control range. The control is accomplished by using a plurality of light modifying elements with each element designed for critically reflecting the passing light and then refracting such light.

BRIEF DESCRIPTION OF THE DRAWINGS

Objects and advantages of the invention will become apparent upon reading the following description and upon reference to the drawings, in which like reference numerals refer to like elements in the various views:

FIG. 2 is an enlarged elevational view taken at the circle indicated by II in FIG. 1.

FIG. 4 is an enlarged elevational view of an alternate embodiment taken at the circle indicated by II in FIG. 1.

FIG. 5 is an elevational view of the embodiment of the present invention illustrated in FIGS. 1 and 4 and showing an idealized radial distribution of light.

DETAILED DESCRIPTION OF THE PREFERRED EMBODIMENTS

Figure 1:
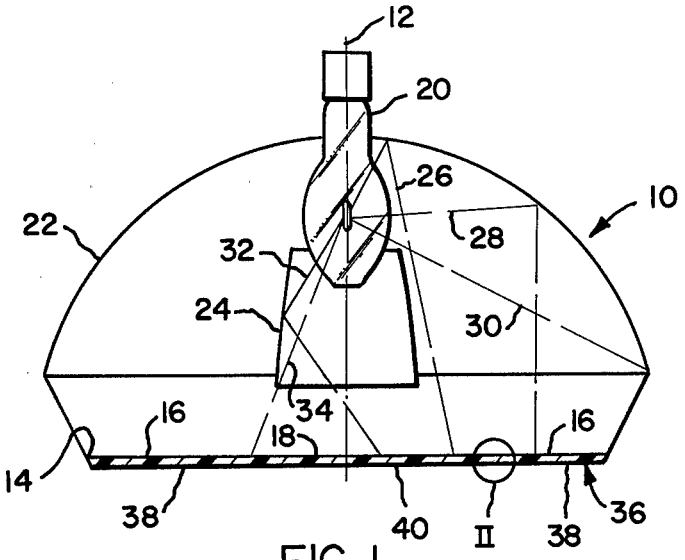
FIG. 1 is a sectional, elevational view of an embodiment of the present invention.

As best seen in FIG. 1, a luminaire 10 has an axis of symmetry 12 and an aperture 14, which is divided into at least a first aperture zone 16 and a second aperture zone 18. Luminaire 10 uses a light source 20 disposed along axis 12, a concave symmetrical reflector means 22 disposed about light source 20 and a deviator means 24 symmetrically disposed about axis 12 within reflector means 22.

Deviator means 24 is designed and positioned within reflector means 22 for preventing the direct passage of light from light source 20 through first aperture zone 16 and for permitting the direct passage of light from light source 20 through second aperture zone 18. A first portion of light represented by rays 26, 28 and 30, illustrate light emitted from light source 20, being reflected from reflector means 22, passing through first aperture zone 16 as locally unidirectional light and providing a first zonal illumination area. A second portion of light, represented by light rays 32 and 34, illustrate light emitted by light source 20, passing through second aperture zone 18 and providing a second zonal illumination area. It is preferred to use a second reflector means in deviator means 24, so that substantially all of the light emitted by light source 20 is permitted to pass through aperture 14.

It is preferred, when practicing the invention, to design reflector means 22 to provide uniform lighting flux across first aperture zone 16. For a given light source 20 and size and location of aperture 14 the design is numerically derived by Snell's law of reflection, certain photometric definitions and selected boundary conditions. The given light source 20 is determined by its candlepower distribution with the distribution of a high intensity discharge lamp being preferred. The size of aperture 14 can be varied, while the location of aperture 14 is preferably extending symmetrically and transversely to axis 12. Snell's law of reflection is well known in the art. The photometric definitions explain how luminous flux is propagated and the selected boundary condition involves using the uppermost point of reflector means 22 to reflect a light ray to the innermost point of first aperture zone 16, illustrated by light ray 26, and using the lowermost point of reflector means 22 to reflect a light ray to the outermost point of first aperture zone 16, illustrated by light ray 30.

Figure 3:
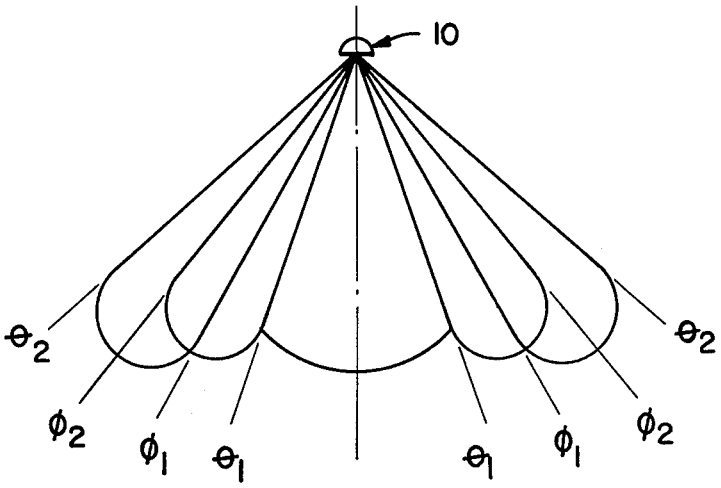
FIG. 3 is an elevational view of the embodiment of the present invention illustrated in FIGS. 1 and 2 and showing an idealized radial distribution of light.

In certain situations, the distribution of all or some of the light passing through aperture 14 should be controlled within a control range. Preferably, the locally unidirectional light passing through first aperture zone 16 is controlled between $\theta_1$ and $\theta_2$ by critically reflecting and then refracting such light. To accomplish this control, a light modifying means 36 is disposed across aperture 14 and has a first zone 38 substantially corresponding to first aperture zone 16 and a second zone 40 substantially corresponding to second aperture zone 18. As the locally unidirectional light passes through first zone 38, the passing light may be controlled by light modifying elements 42 having an axis of symmetry 44, FIG. 2, or by light modifying elements 46 having an axis of symmetry 48, FIG. 4. Light modifying elements 42 critically reflect and then refract the locally unidirectional rays of light to provide a radial light distribution of two peak intensities, $\phi_1$ and $\phi_2$, within the control range, $\theta_1$ and $\theta_2$, as illustrated in FIG. 3. Light modifying elements 46 critically reflect and then refract the locally unidirectional light rays to provide a radial light distribution of a single peak intensity, $\phi_3$ within the control range, $\theta_1$ and $\theta_2$, as illustrated in FIG. 5.

To obtain proper control of the light distribution within the control range, light modifying elements 42 or 46 must be properly oriented with respect to the incoming light. This orientation may be accomplished in at least two ways. One way is to direct the base of each element 42 or 46 generally toward the locally unidirectional light, thereby forming an angle $\alpha$ between the axis of symmetry of each element 42 or 46 and a normal to light modifying means 36, as illustrated by angles $\alpha_1$, $\alpha_2$, $\alpha_3$ and $\alpha_4$ in FIG. 2. The size of these angles depend on the angles of the incoming unidirectional light rays and can be determined by ray traces from light source 20 to reflector means 22 and then to first aperture zone 16. A second way to orient light modifying elements 42 and 46 relative to the incoming light involves converting the locally unidirectional light into substantially collimated light. This conversion is accomplished by locating a Fresnel lens 50 across first aperture zone 16 above light modifying means 36. Fresnel lens 50 is designed by using conventional techniques and ray traces from light source 20 to reflector 22 and then to first aperture zone 16. Axis of symmetry 44 and 48 for light modifying elements 42 and 46, respectively, are positioned to be substantially parallel to the substantially collimated light, as illustrated in FIG. 4. By such orientation of light modifying elements 42 and 46, light passing through light modifying means 36 is controlled within the desired control range by critically reflecting and then refraction such light.

What is claimed is:

1. A luminaire for displaying locally unidirectional light through zones of substantially equal illumination, comprising:

a high intensity discharge light source for emitting light;

a reflector having a reflecting surface extending to a boundary substantially defining an aperture of the luminaire to reflect from the reflecting surface a portion of the light from the light source as locally unidirectional light through a first illumination zone of the aperture of the luminaire; and deviator means disposed before the reflector for preventing the direct passage of light from said light source to the first illumination zone of the aperture, the deviator means and the reflector each being individually shaped and disposed to cause a light source light ray reflected at the innermost part of the reflecting surface of the reflector to pass outward of the deviator means to be transmitted to the innermost part of the first illumination zone of the aperture and to cause a light source light ray reflected at the outermost part of the reflecting surface of the reflector means to be transmitted to the outermost part of the first illumination zone of the aperture, the deviator means being disposed to deviate light source light rays not reflected by the reflecting surface inward of the deviator means to a second illumination zone of the aperture of the luminaire, inward of the first illumination aperture zone, to provide substantially equal illumination in the first and second zones of the aperture of the luminaire.

2. A luminaire for displaying substantially uniformly distributed locally unidirectional light flux, comprising:

a high intensity discharge light source for emitting light;

a reflector having a reflecting surface extending to a boundary substantially defining an aperture of the luminaire to reflect from the reflecting surface a portion of the light from the light source as locally unidirectional light substantially uniformly across a first illumination zone of the aperture; and deviator means disposed before the reflector for preventing the direct passage of light from said light source to the first illumination zone of the aperture, the deviator means being disposed to deviate light source light rays not reflected by the reflecting surface through the deviator means to a second illumination zone of the aperture of the luminaire, inward of the first illumination aperture zone, the deviator means in cooperation with the reflector providing locally unidirectional light flux uniformly distributed across the first illumination zone of the aperture.

* * * * *

UNITED STATES PATENT AND TRADEMARK OFFICE

CERTIFICATE OF CORRECTION

PATENT NO. : 4,088,883

DATED : May 9, 1978

INVENTOR(S) : Thomas W. Dey

It is certified that error appears in the above-identified patent and that said Letters Patent are hereby corrected as shown below:

In the Title, delete "LUMINAIRE" and substitute therefor

-- LUMINAIRE FOR CONTROLLING LOCALLY UNIDIRECTIONAL LIGHT --.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*